United States Patent [19]

Stancil

[11] Patent Number: 4,825,587

[45] Date of Patent: May 2, 1989

[54] CHRISTMAS TREE IRRIGATION SYSTEM

[76] Inventor: Danny R. Stancil, 5220 Troutman La., Raleigh, N.C. 27612

[21] Appl. No.: 180,521

[22] Filed: Apr. 12, 1988

[51] Int. Cl.[4] ..... A47G 7/02

[52] U.S. Cl. ..... 47/40.5

[58] Field of Search ..... 47/39, 40.5, 66, 79–81; 222/51, 56, 64, 67, 68

[56] References Cited

U.S. PATENT DOCUMENTS

| | | | |
|---|---|---|---|
| 1,805,649 | 5/1931 | Wermine | 47/40.5 |
| 1,894,367 | 1/1933 | Corcoran | 222/64 |
| 3,144,172 | 8/1964 | Mason | 222/51 |
| 3,323,253 | 6/1967 | Robins | 47/79 |
| 3,697,026 | 10/1972 | Hambrick | 47/40.5 |
| 4,083,147 | 4/1978 | Garrick | 47/80 |
| 4,300,311 | 11/1981 | Marchant | 47/79 |
| 4,653,224 | 3/1987 | Weckesser | 47/40.5 |

FOREIGN PATENT DOCUMENTS

| | | | |
|---|---|---|---|
| 2813410 | 10/1979 | Fed. Rep. of Germany | 47/79 |
| 1431064 | 4/1976 | United Kingdom | 47/66 |

*Primary Examiner*—Robert A. Hafer
*Assistant Examiner*—Charles H. Sam
*Attorney, Agent, or Firm*—Richard E. Jenkins

[57] ABSTRACT

A Christmas tree irrigation system for supplying water to a tree stand at the base of the Christmas tree. The system includes a tree stand and a spaced-apart reservoir having an electric pump therein which is connected to a conduit leading to a tree stand. The pump is adapted to be actuated by a power source when the water level in the tree stand diminishes to a predetermined level so as to close an electric switch operatively associated with the tree stand.

15 Claims, 3 Drawing Sheets

CHRISTMAS TREE IRRIGATION SYSTEM

DESCRIPTION

1. Technical Field

The present invention relates to an irrigation system for a Christmas tree or the like and more particularly to an irrigation system which by means of an automated system maintains the fluid level in a Christmas tree stand.

2. Background Art

Heretofore, many efforts have been made to provide a Christmas tree stand with an associated reservoir to provide replenishment of the water in the stand as it is depleted by the Christmas tree. This has been found to be necessary since some Christmas trees are capable of absorbing as much as several quarts of water daily and, if a stand is not periodically replenished with water, the Christmas tree therein will become dry and a fire hazard much more quickly than would ordinarily be the case.

Prior efforts to develop a satisfactory self-replenishing Christmas tree stand include U.S. Pat. No. 3,137,969 to Sokol which discloses an automatic water dispenser for a Christmas tree comprising a doughnut-shaped reservoir and a cylindrical open well located beneath the reservoir. A valve provided between the reservoir and the open well serves to replenish the water in the well when it falls below a certain predetermined level. Also of interest is the Christmas tree irrigation device disclosed in Reckesser for supplying water to a Christmas tree stand. The device comprises a water reservoir container having a conduit extending from the bottom thereof into the Christmas tree stand. When it is desired to introduce water from the container into the Christmas tree stand, the water-filled container is lifted so that the water will be siphoned therefrom into the stand and the container is then lowered to floor level so that the siphoning action may automatically continue.

As can now be appreciated, all previously known devices providing for replenishing of water in a Christmas tree stand necessitate relatively large and unsightly apparatus which must be associated with the Christmas tree. This, of course, is very undesirable in view of the fact that both the tree and packages typically surrounding the tree are highly decorated and the presence of tree stand water replenishment apparatus known heretofore diminishes from the beauty of the tree. Applicant has overcome this problem with the automated system of the present invention which is unexpectedly effective as well as being unobtrusive in appearance.

DISCLOSURE OF THE INVENTION

In accordance with the present invention, Applicant provides an improved irrigation system for a Christmas tree stand which is designed specifically for superior performance as well as being unobtrusive in appearance. The Christmas tree irrigation system comprises a stand adapted for securing a Christmas tree in an upright position and including an electric switch therein which is adapted to close when the water in the stand drops below a predetermined level. A reservoir of replenishment water is spaced-apart from the stand and has a conduit extending therefrom to the stand for supplying water thereto. An electric pump in fluid communication with the reservoir is connected to the conduit, and a power source is electrically connected to the pump and switch means in the tree stand so as to actuate the pump when the switch means in the tree stand closes the electrical circuit connecting the pump and the power source. A container simulating the appearance of a Christmas package is provided to receive the reservoir, electric pump and power source therein so as to substantially hide these components from view under a Christmas tree in the guise of a Christmas package. In this fashion, the fluid level in the Christmas tree stand is automatically replenished from the reservoir whenever the level thereof is depleted by the tree positioned in the stand.

It is therefore the object of this invention to provide an improved automated fluid replenishment system for a Christmas tree stand.

Another object of the present invention is to provide an improved automated fluid replenishment system for a Christmas tree stand which substantially simulates the appearance of a Christmas package and is thus easily hidden under a Christmas tree.

BRIEF DESCRIPTION OF THE DRAWINGS

Some of the objects of the invention having been stated, other objects will become evident as the description proceeds, when taken in connection with the accompanying drawings, in which.

BEST MODE FOR CARRYING OUT THE INVENTION

Figure 1:
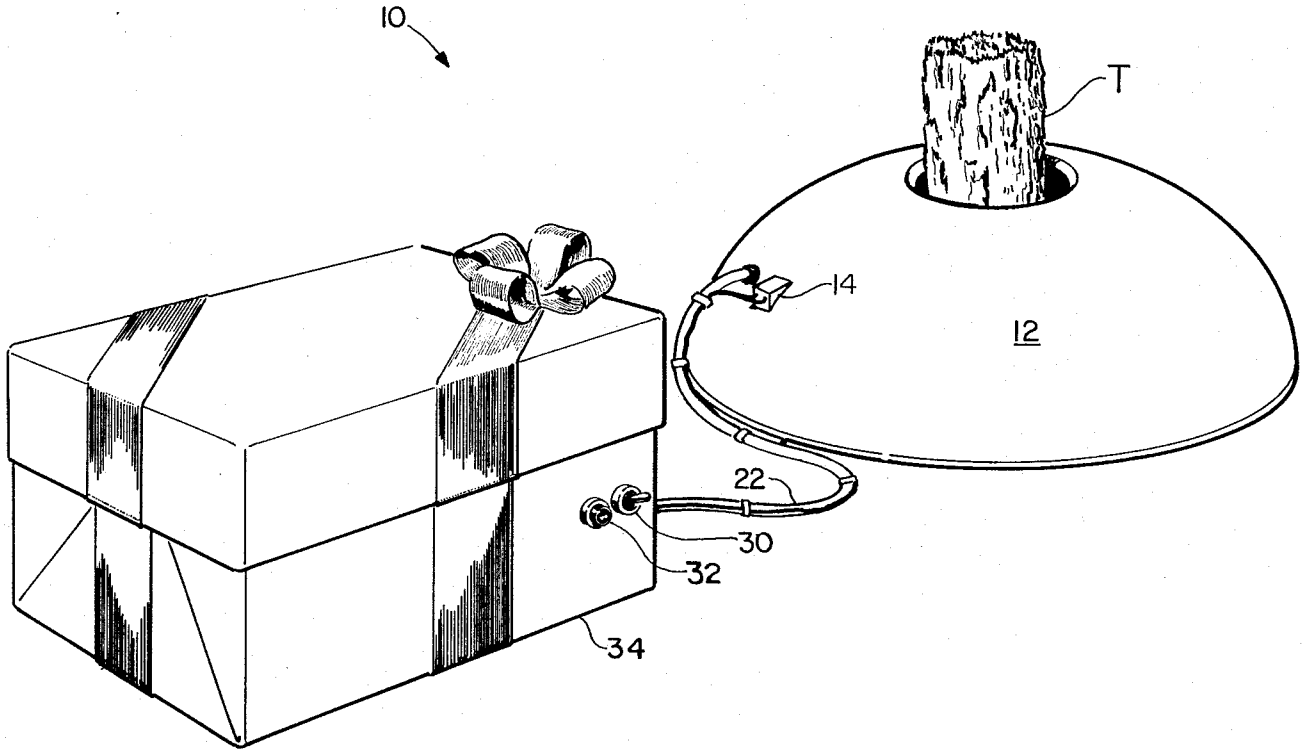
FIG. 1 is a perspective view of the Christmas tree irrigation system of the present invention.
Figure 2:
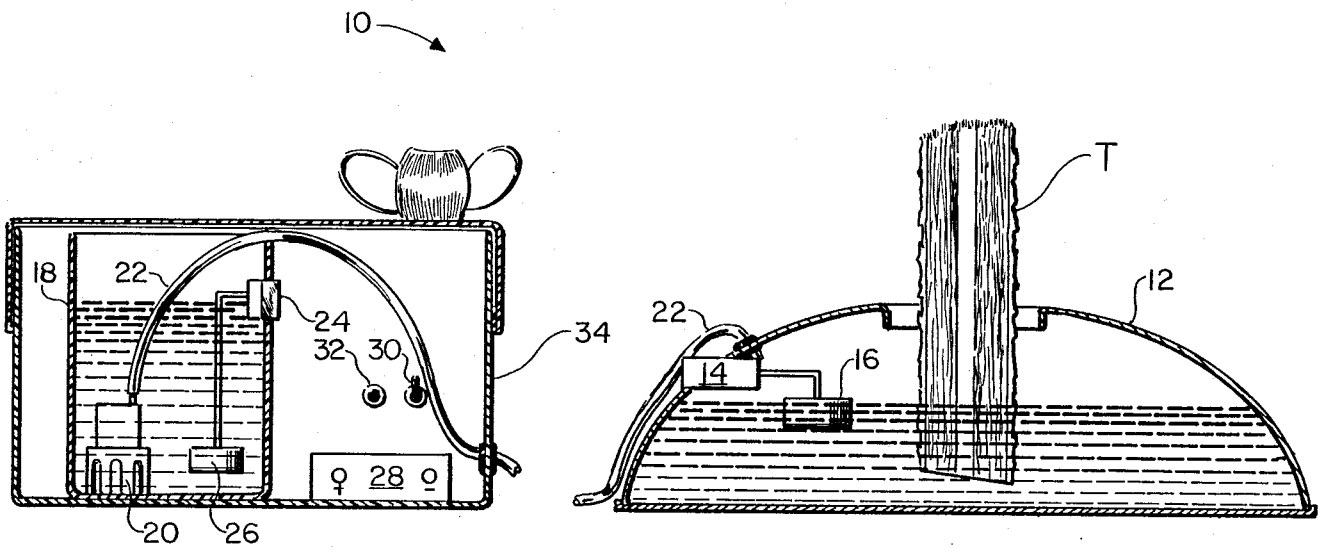
FIG. 2 is a cross-sectional elevation view of the tree irrigation system of the present invention.

With particular reference now to FIGS. 1 and 2 of the drawings, the Christmas tree irrigation system of the present invention is generally designated 10. Irrigation system 10 comprises tree stand 12 which is water tight and may be of any conventional structure known to those familiar therewith. An electronic switch 14 is operatively associated with tree stand 12 and includes a float 16 associated therewith so as to maintain electric switch 14 in an open position until the fluid level, typically water, in tree stand 12 drops to a certain predetermined level and float 16 drops therewith and closes electrical switch 14.

A reservoir 18 is spaced-apart from tree stand 12 and adapted to contain a supply of water for replenishing the water level in tree stand 12 when it becomes depleted. An electric pump 20 is positioned in reservoir 18 and connected to a conduit 22 extending from reservoir 18 at one end and into tree stand 12 at the other end thereof. A second electrical switch 24 is operatively associated with reservoir 18 and includes a float 26 connected thereto which maintains the switch in a closed position until the water level in reservoir 18 reaches a predetermined level substantially at the bottom thereof and float 26 serves to open second electrical switch 24. It should be appreciated that second electrical switch 24 is provided in order to open the circuitry of irrigation system 10 whenever the water level in reservoir 18 has been fully depleted. A battery 28 is electrically connected to pump 20 and serves to motivate the pump when the electrical circuitry of irrigation system 10 is closed, as will be more fully explained below. A third electrical switch 30 is provided in electrical connection with the aforementioned battery 28, electrical switches 14 and 24, and electric pump 20 in order to allow the user of irrigation system 10 to turn the system either on or off as desired. Finally, a Light Emitting Diode (LED) 32 is provided in electrical connection with second electrical switch 24 so that when the water level is depleted and float 26 has opened electrical switch 24, the circuit containing LED 32 will be closed and LED 32 illuminated to indicate that reservoir 18 is empty.

Tree irrigation system 10 still further provides for a decorative container 34 (see FIG. 1) to enclose reservoir 18, electric pump 20, second electrical switch 24 and battery 28, so as to give the reservoir components of irrigation system 10 the decorative and simulated appearance of a Christmas package. Thus, decorative container 34 may be positioned under a Christmas tree in proximity to real Christmas packages with only conduit 22 extending from decorative container 34 to tree stand 12. In this fashion, an automatic system is provided to maintain the water level in Christmas tree stand 12 which is neither obtrusive or even noticeable by those persons looking at the Christmas tree supported by tree stand 12.

Figure 3:
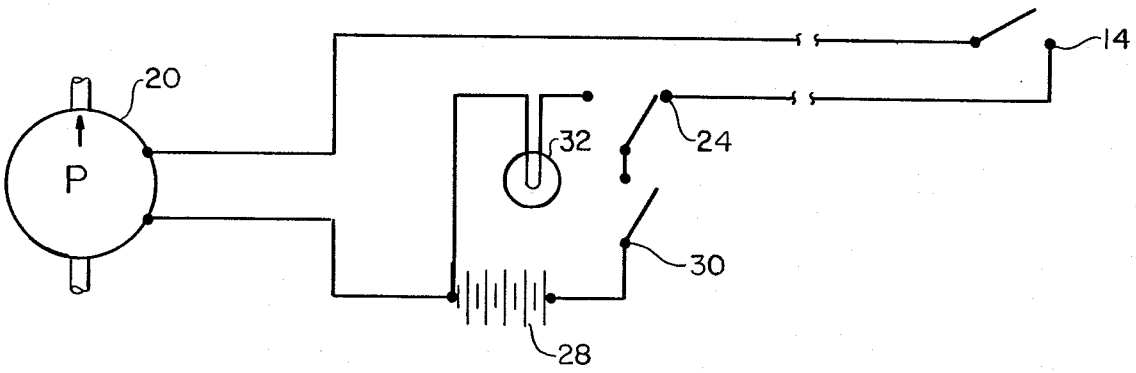
FIG. 3 is a schematic diagram of the electrical circuit of the Christmas tree irrigation system of the present invention.

In operation (see FIG. 3), irrigation system 10 is actuated by closing third electric switch 30 since second electric switch 24 will be closed when water is in reservoir 18. Thus, first electric switch 14 will control whether or not the electric circuit to pump 20 is open or closed when third electric switch 30 is closed and second electric switch 24 is closed due to the presence of water in reservoir 18. The electrical circuit to pump 20 will be open since electric switch 14 will be open so long as the water level in tree stand 12 is maintained above a certain level. When the water level in tree stand 12 drops to a predetermined level adjacent the bottom of the stand, first electric switch 14 will close and thereby complete the circuit to electric pump 20 which will then be actuated and pump water from reservoir 18 to tree stand 12 until the water level and float 16 have risen sufficiently for first electric switch 14 to again open and thus de-actuate electric pump 20. When the water level in reservoir 18 is substantially depleted, second electric switch 24 will open and in this condition even if first electrical switch closes the electrical circuit to pump 20 will be open and the pump will not be actuated until the water level in reservoir 18 is replenished. As noted earlier, and as best seen in FIG. 3, when second electric switch 24 is open due to the water level in reservoir 18 having been depleted, the circuit containing LED 32 is actuated so as to illuminate LED 32 and indicate the need to replenish the water in reservoir 18. Most suitably, third electric switch 30 and LED 32 are provided on the outside of decorative container 34 to facilitate operation of the irrigation system of the present invention.

It will be understood that various details of the invention may be changed without departing from the scope of the invention. Furthermore, the foregoing description is for the purpose of illustration only, and not for the purpose of limitation—the invention being defined by the claims.

What is claimed is:

1. A Christmas tree irrigation system comprising:

a fluid-retaining stand adapted for engaging the base of a Christmas tree so as to secure the tree in an upright position;

first electric switch means operatively associated with said stand and adapted to close when the fluid in said stand drops below a predetermined level;

a spaced-apart reservoir having a conduit leading from said reservoir to said stand for supplying fluid thereto;

an electric pump in fluid communication with said reservoir, said pump being fluidly connected to the conduit leading to said stand and electrically connected to said first switch means;

a power source electrically connected to said electric pump and said first switch means so as to actuate said pump when said switch means closes to complete the electrical circuit connecting said pump and said power source; and second electric switch means operatively associated with said reservoir and in electrical connection with said power source, said electric pump and said first switch means, said second electric switch means adapted to open when the fluid level in said reservoir drops below a predetermined level;

whereby the fluid level in said stand is replenished from said reservoir whenever the level thereof is depleted by a Christmas tree positioned in said stand and whereby said electric pump is de-actuated when the fluid level in said reservoir drops below a predetermined level.

2. A Christmas tree irrigation sytem according to claim 1 wherein said reservoir, said electric pump, and said power source are positioned within a decorative container.

3. A Christmas tree irrigation system accoding to claim 2 wherein said decorative container simulates the appearance of a Christmas package.

4. A Christmas tree irrigation system according to claim 2 wherein said electric pump is located in said reservoir.

5. A Christmas tree irrigation system according to claim 1 including manual switch means in electrical connection with said power source and adapted to actuate and de-actuate the Christmas tree irrigation system as desired.

6. A Christmas tree irrigation system according to claim 1 wherein said power source comprises a battery.

7. A Christmas tree irrigation system comprising:

a fluid-retaining stand adapted for engaging the base of a Christmas tree so as to secure the tree in an upright position;

first electric switch means provided in said stand and adapted to close when the fluid in said stand drops below a predetermined level;

a spaced-apart reservoir having a conduit leading from said reservoir to said stand for supplying fluid thereto;

an electric pump positioned in said reservoir; said pump being fluidly connected to the conduit leading to said stand and electrically connected to said first switch means;

a battery positioned proximate to said electric pump and electrically connected to said electric pump and said first switch means so as to actuate said pump when said switch means closes and completes the electrical circuit connecting said pump and said battery;

second electric switch means operatively associated with said reservoir and in electrical connection with said power source, said electric pump and said first switch means, said second electric switch means adapted to open when the fluid level in said reservoir drops below a predetermined level; and a decorative container simulating the appearance of a Christmas package and adapted to receive said reservoir, said electric pump, said battery, and said second switch means therein;

whereby the fluid level in said stand is replenished from said reservoir whenever the level thereof is depleted by a Christmas tree positioned in said stand and whereby said electric pump is de-actuated when the fluid level in said reservoir drops below a predetermined level.

8. A Christmas tree irrigation system according to claim 7 including manual switch means in electrical connection with said battery and adapted to actuate and de-actuate the Christmas tree irrigation system as desired.

9. A Christmas tree irrigation system according to claim 1 further comprising an indicator light in electrical connection with said second switch means and said power source so as to become illuminated upon the opening of said second switch means.

10. A Christmas tree irrigation system according to claim 7 further comprising an indicator light in electrical connection with said second switch means and said batery so as to become illuminated upon the opening of said second switch means.

11. A Christmas tree irrigation system comprising:

a fluid-retaining stand adapted for engaging the base of a Christmas tree so as to secure the tree in an upright position;

first electric switch means operatively associated with said stand and adapted to close when the fluid in said stand drops below a predetermined level;

a spaced-apart reservoir having a conduit leading from said reservoir to said stand for supplying fluid thereto;

an electric pump in fluid communication with said reservoir, said pump being fluidly connected to the conduit leading to said stand and electrically connected to said first switch means;

a power source electrically connected to said electric pump and said first switch means so as to actuate said pump when said switch means closes to complete the electrical circuit connecting said pump and said power source;

second electric switch means operatively associated with said reservoir and in electrical connection with said power source, said electric pump and said first switch means, said second electric switch means adapted to open when the fluid level in said reservoir drops below a predetermined level; and indicator means in electrical connection with said second switch means and said power source, said indicator means being adapted to be actuated upon the opening of said second switch means;

whereby the fluid level in said stand is replenished from said reservoir whenever the level thereof is depleted by a Christmas tree positioned in said stand, and whereby said electric pump is de-actuated and said indicator means is actuated when the fluid level in said reservoir drops below a predetermined level so as to indicate that the fluid in said reservoir has been depleted.

12. A Christmas tree irrigation system according to claim 11 wherein said indicator means comprises a Light Emitting Diode.

13. A Christmas tree irrigation system according to claim 11 wherein said power source comprises a battery.

14. A Christmas tree irrigation system according to claim 11 wherein said reservoir, said electric pump, said power source and said second switch means are positioned within a decorative container having the appearance of a Christmas package.

15. A Christmas tree irrigation system according to claim 11 including manual switch means in electrical connection with said power source and adapted to actuate and de-actuate the Christmas tree irrigation system.

* * * * *